US011784447B2

(12) United States Patent
Xue et al.

(10) Patent No.: US 11,784,447 B2
(45) Date of Patent: Oct. 10, 2023

(54) EMBEDDED SHELF POWER TAKING SYSTEM

(71) Applicants: Self Electronics Co., Ltd., Zhejiang (CN); Wanjiong Lin, Zhejiang (CN); Self Electronics USA Corporation, Norcross, GA (US)

(72) Inventors: Yuanfang Xue, Zhejiang (CN); Zhaoyong Zheng, Zhejiang (CN); Junjun Ying, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 205 days.

(21) Appl. No.: 17/456,701

(22) Filed: Nov. 29, 2021

(65) Prior Publication Data

US 2022/0173557 A1 Jun. 2, 2022

(30) Foreign Application Priority Data

Nov. 30, 2020 (CN) ..... 202011379437.2

(51) Int. Cl.

| | |
|---|---|
| ***H01R 25/14*** | (2006.01) |
| ***H01R 25/16*** | (2006.01) |
| ***A47B 96/06*** | (2006.01) |
| *F21V 21/35* | (2006.01) |
| *H01R 13/24* | (2006.01) |

(52) U.S. Cl.

CPC ..... *H01R 25/162* (2013.01); *A47B 96/06* (2013.01); *A47B 2220/0091* (2013.01); *F21V 21/35* (2013.01); *H01R 13/2478* (2013.01)

(58) Field of Classification Search

CPC .... H01R 25/162; H01R 25/161; H01R 25/16; H01R 25/147; H01R 25/145; H01R 25/14; H01R 13/2478; A47B 96/06; A47B 2220/0091; F21V 21/35

See application file for complete search history.

(56) References Cited

U.S. PATENT DOCUMENTS

| | | | | | |
|---|---|---|---|---|---|
| 3,529,274 | A * | 9/1970 | Routh | F21V 21/35 | 439/118 |
| 3,638,885 | A * | 2/1972 | Reed | B64C 27/51 | 416/106 |
| 4,655,520 | A * | 4/1987 | Cummings | F21V 21/35 | 439/111 |
| 5,128,847 | A * | 7/1992 | Lin | H01R 25/142 | 362/147 |
| 6,039,584 | A * | 3/2000 | Ross | H01R 25/14 | 439/115 |
| 6,296,498 | B1 * | 10/2001 | Ross | H01R 25/145 | 439/115 |

(Continued)

*Primary Examiner* — Harshad C Patel

(74) *Attorney, Agent, or Firm* — Wang Law Firm, Inc.

(57) ABSTRACT

An embedded shelf power taking system has a power supply track and an electrical component disposed on the power supply track, the power supply track has two strip-shaped baffles, a bottom plate and two strip-shaped electrical conductive members; the embedded shelf power taking system of the invention can be embedded into the wall for hidden installation, integrates the functions of fixing the laminate and fetching electricity with electric appliances on the laminate, and can fetch electricity at the same time when installing the laminate, which is convenient for installation and stable and reliable for fetching electricity.

12 Claims, 12 Drawing Sheets

(56) References Cited

U.S. PATENT DOCUMENTS

| | | | | |
|---|---|---|---|---|
| 6,325,645 | B1 * | 12/2001 | Schuite | F21V 21/35 439/118 |
| 7,094,077 | B1 * | 8/2006 | Chen | H01R 25/142 439/118 |
| 7,252,524 | B1 * | 8/2007 | Johnson, Jr. | H05K 7/1457 439/118 |
| 7,485,015 | B2 * | 2/2009 | Coffy | H01R 9/2675 439/828 |
| 7,497,711 | B2 * | 3/2009 | Gherardini | H01R 25/162 439/212 |
| 7,544,071 | B2 * | 6/2009 | Jong | H01R 25/142 439/118 |
| 7,597,565 | B1 * | 10/2009 | Jorgensen | H01R 43/10 439/111 |
| 7,744,386 | B1 * | 6/2010 | Speidel | H01R 25/145 439/118 |
| 8,961,201 | B2 * | 2/2015 | Griese | H01R 9/2675 439/121 |
| 9,136,659 | B2 * | 9/2015 | Fishman | H01R 29/00 |
| 9,455,510 | B2 * | 9/2016 | Busch | H05K 7/1469 |
| 10,461,483 | B2 * | 10/2019 | Gellert | H01R 13/62916 |
| 10,520,180 | B1 * | 12/2019 | Ji | F21S 4/28 |
| 10,770,850 | B2 * | 9/2020 | Gellert | H02G 5/00 |
| 2006/0209531 | A1 * | 9/2006 | Tiesler | B60R 16/03 362/183 |
| 2014/0293516 | A1 * | 10/2014 | Swift | H02B 1/04 248/65 |
| 2019/0191649 | A1 * | 6/2019 | Lorenzana | A01H 6/4684 |
| 2019/0368720 | A1 * | 12/2019 | Xue | F21S 4/28 |
| 2021/0007483 | A1 * | 1/2021 | Zheng | H01R 25/14 |

* cited by examiner

EMBEDDED SHELF POWER TAKING SYSTEM

RELATED APPLICATION

This application claims priority to a Chinese Patent Application No. CN 202011379437.2, filed on Nov. 30, 2020.

FIELD OF THE TECHNOLOGY

The present invention relates to the field of electricity delivery, in particular, an embedded shelf power taking system.

BACKGROUND OF THE INVENTION

At present, the power supply on the shelf is mainly set on the back of the shelf, and it supplies power to LED lamps by interconnection wire. With this type of power supply, it is often necessary to provide perforations on the shelf or need to bring the wire from the back of the shelf to the front of the shelf, resulting in inconvenience installation, difficulty in repair; If more than one LED lamp is set in the shelf, it will cause a plurality of wires in the shelf to be jumbled and staggered, occupy more space, and affect the overall beauty of the shelf and the effect of commodity display.

In order to solve the above problems, in the prior art, the electricity distribution of different positions is achieved by setting the power supply rail, and generally, the power supply track includes a track body and a conductive strip-shaped provided on the track body, and power supply is realized by a electrical head matched with the power supply track. Wherein, the main installation methods include table stick installation and inserted into the shelf column installation, and table stick installation has the problem of bare, and some shelves do not have columns, which cannot achieve internal installation. Therefore, it is necessary to design an electrical system that can embed the shelf to solve this problem.

BRIEF SUMMARY OF THE INVENTION

In view of this, the present invention provides an embedded shelf power taking system to refine the power generation system to solve the above technical problems.

An embedded shelf power taking system comprises a power supply track and an electrical component disposed on the power supply track, and the power supply track comprises:

two strip-shaped baffles, which are arranged opposite;

a bottom plate, located on the same side of the two strip-shaped baffles and connected to the two strip-shaped baffles;

and two strip-shaped electrical conductive members, which are arranged on the inside of the two strip-shaped baffles, respectively;

the electrical component comprises:

a laminate fixing member, which is fixedly connected with the power supply track;

a mounting seat, which is fixed to the laminate fixing member and is provided with a socket which can be inserted between two strip-shaped baffles;

two elastic electrical taking members, which are arranged in the mounting seat; each elastic electrical taking member comprises a fixing portion arranged on the mounting seat and an elastic portion extending from the fixing portion to the socket, and the two elastic portions are respectively disposed on both sides of the socket and are connected with the strip-shaped electrical conductive member;

and an external connector, electrically connected with the elastic electrical taking member.

the bottom plate is provided with a plurality of connection holes that are distributed in the longitudinal direction, and the laminate fixing member is provided with a hook portion matching with the connecting hole.

the outer side of the strip-shaped baffle is provided with an outwardly extending first fixing plate.

a outer side of the bottom plate is provided with an outwardly extending second fixing plate.

the inner side of the strip-shaped baffle is provided with an inclined guide section, and the two guide sections form a guide zone.

the mounting seat further comprises a strip-shaped positioning piece that is clamped into the guide zone, and the strip-shaped positioning piece extends along the longitudinal direction of the power supply track and is provided with a positioning slope that abutting cooperates with the guide section.

the strip-shaped baffle is made of metal material, and the power supply track further comprises a strip-shaped insulating lining plate arranged inside the strip-shaped baffle, and the electrical conductive member is arranged on the strip-shaped insulating lining plate.

the socket is a hollow shell structure, and an opening is arranged on its both sides for the elastic portion to extend out.

the fixing portion and the elastic portion are integrally formed elastic sheets, and the elastic portion is formed by the fixing portion extending to the socket.

the elastic portion is provided with a hemispherical convex point protruding outward as a contact point.

the elastic portion is bent inward from the fixing portion and bent outward near the socket.

both sides of the socket are provided with a positioning wall extending along the length direction of the power supply track.

THE TECHNICAL EFFECTS OF THE PRESENT INVENTION

The embedded shelf power taking system of the invention can be embedded into the wall for hidden installation, integrates the functions of fixing the laminate and fetching electricity with electric appliances on the laminate, and can complete the action of fetching electricity at the same time when installing the laminate, which is convenient for installation and stable and reliable for fetching electricity.

BRIEF DESCRIPTION OF THE DRAWINGS

Embodiments of the present invention will be described below with reference to the drawings, in which.

DETAILED DESCRIPTION OF THE INVENTION

Specific embodiments of the present invention will be described in further detail below based on the drawings. It should be understood that the description of the embodiments of the present invention herein is not intended to limit the protection scope of the present invention. A specific embodiment of the present invention will be further described below based on the drawings. It should be understood that the description of the embodiments of the present invention is not intended to limit the scope of the invention.

Figure 1:
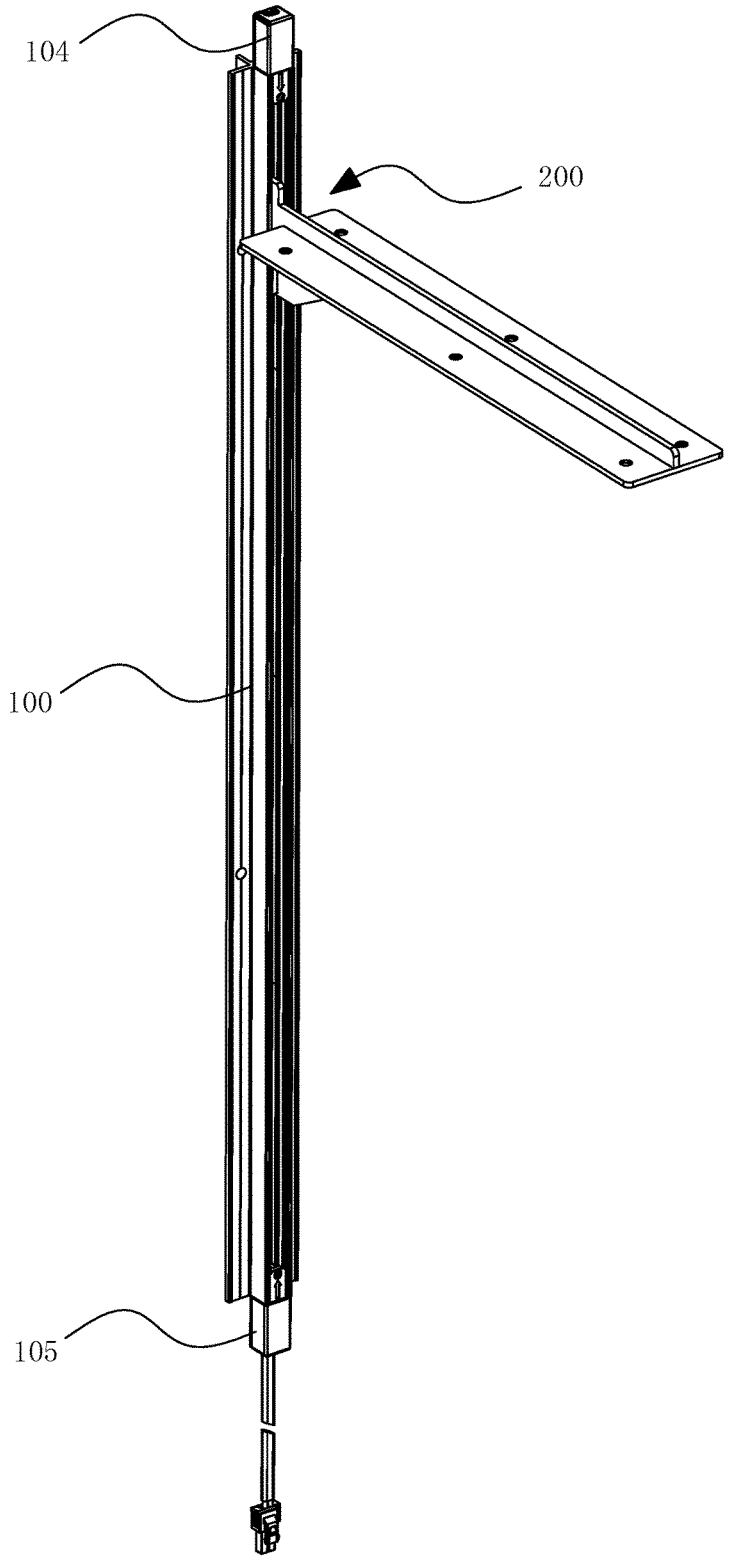
FIG. 1 is a structural diagram of the embedded shelf power taking system for the present embodiment.
Figure 2:
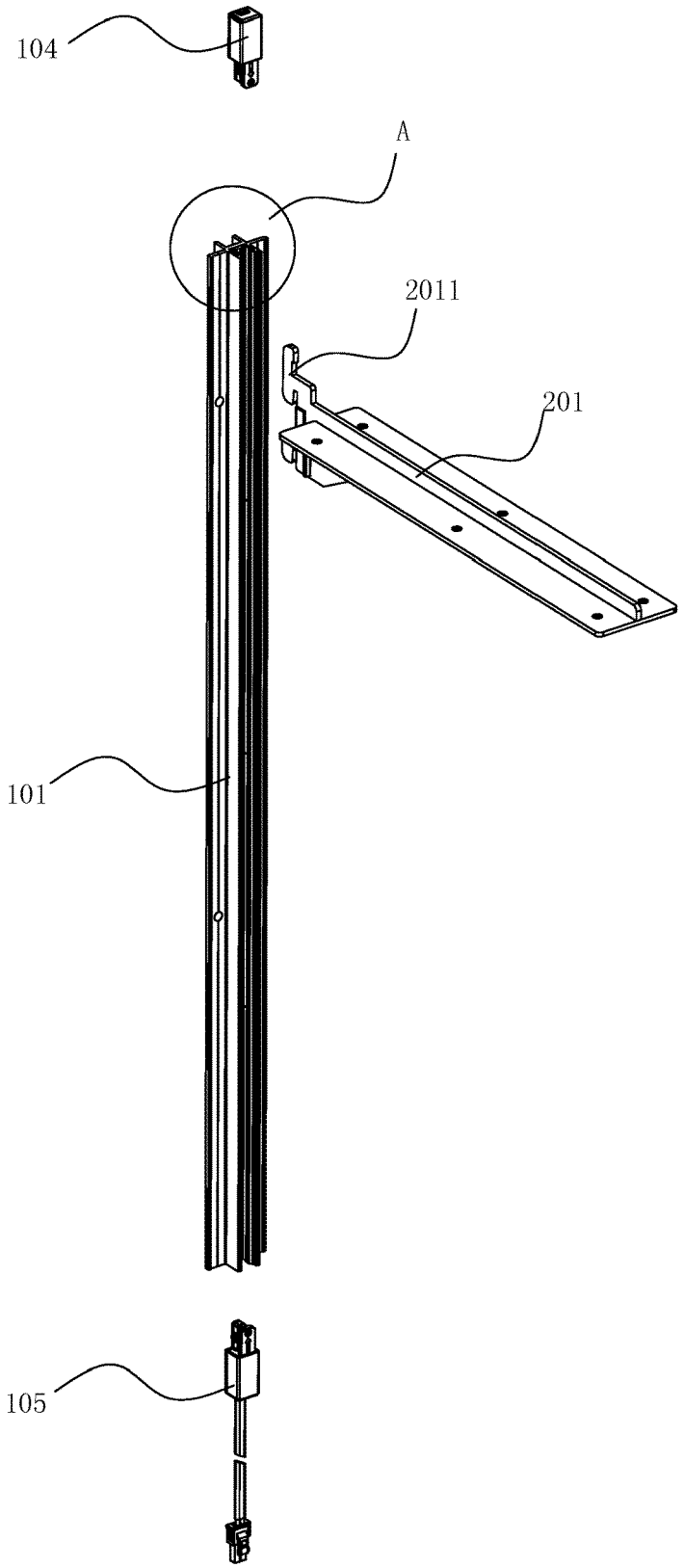
FIG. 2 is a structural diagram of the embedded shelf power taking system for the present embodiment (before assembly).
Figure 3:
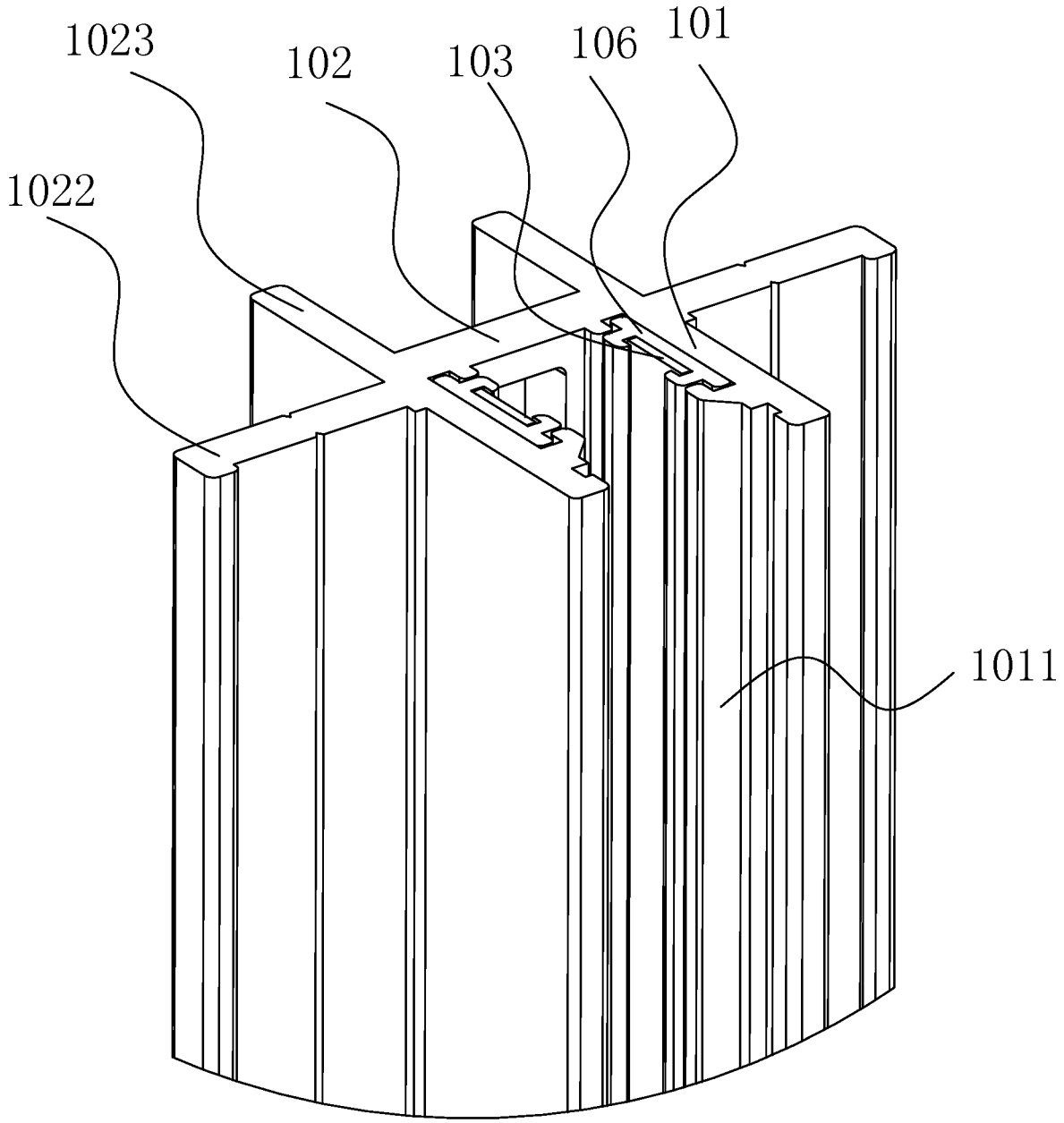
FIG. 3 is an enlargement diagram of the part A in FIG. 2.
Figure 4:
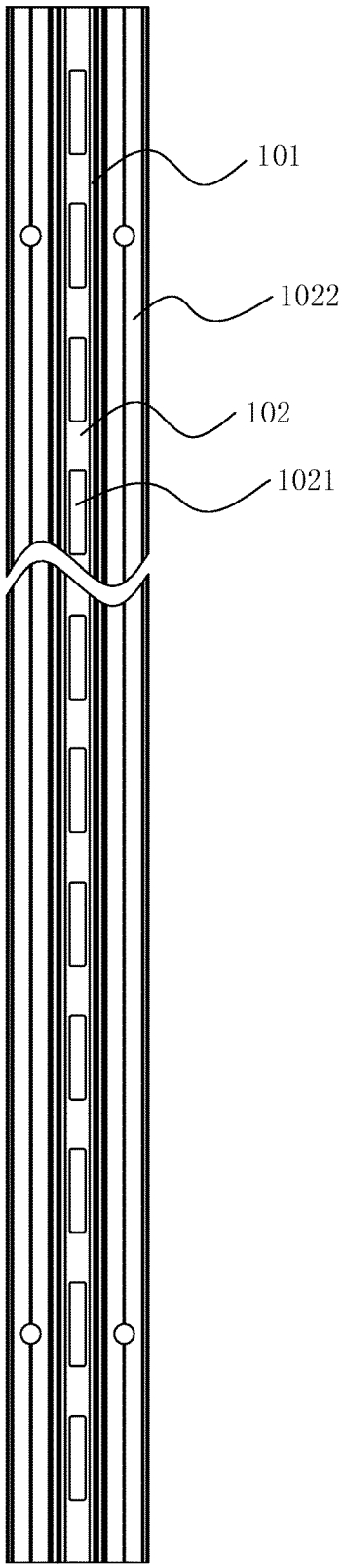
FIG. 4 is a schematic structural view of the power supply rail of the present embodiment.
Figure 5:
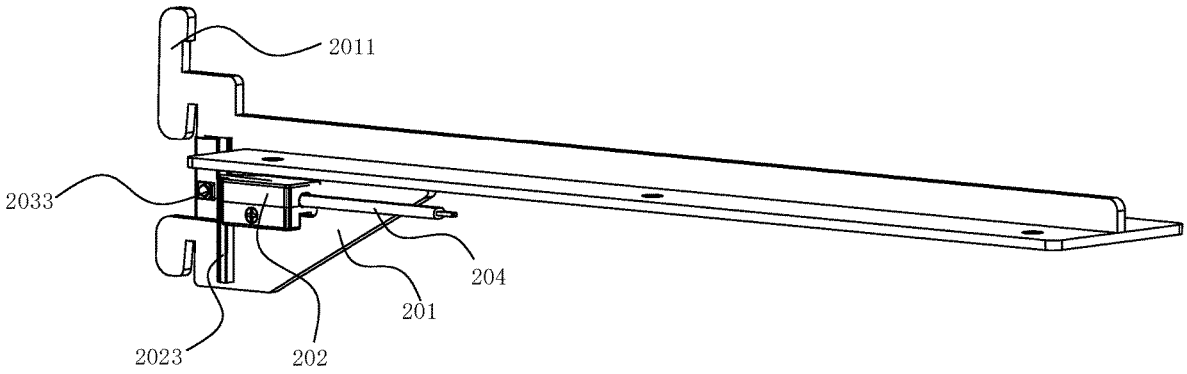
FIG. 5 is a schematic structural diagram of the electrical component of the present embodiment.
Figure 6:
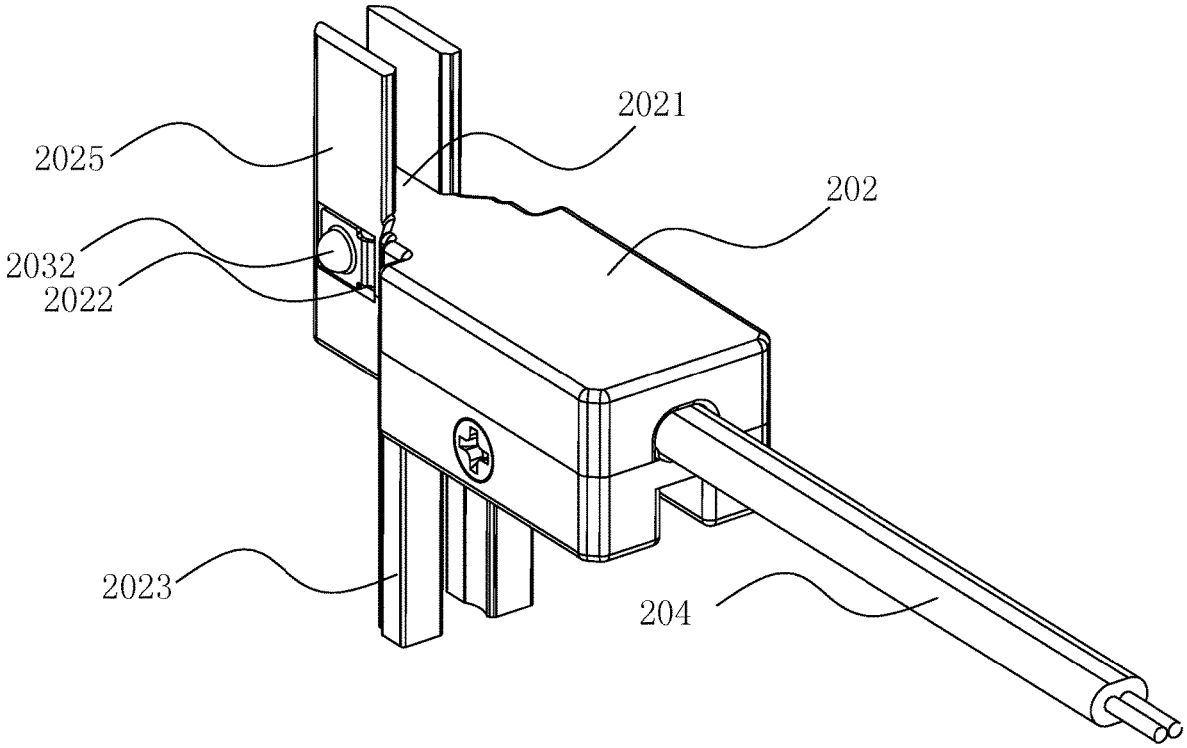
FIG. 6 is a structural diagram of an electrical component (removal laminate fixing member) of the present embodiment.
Figure 7:
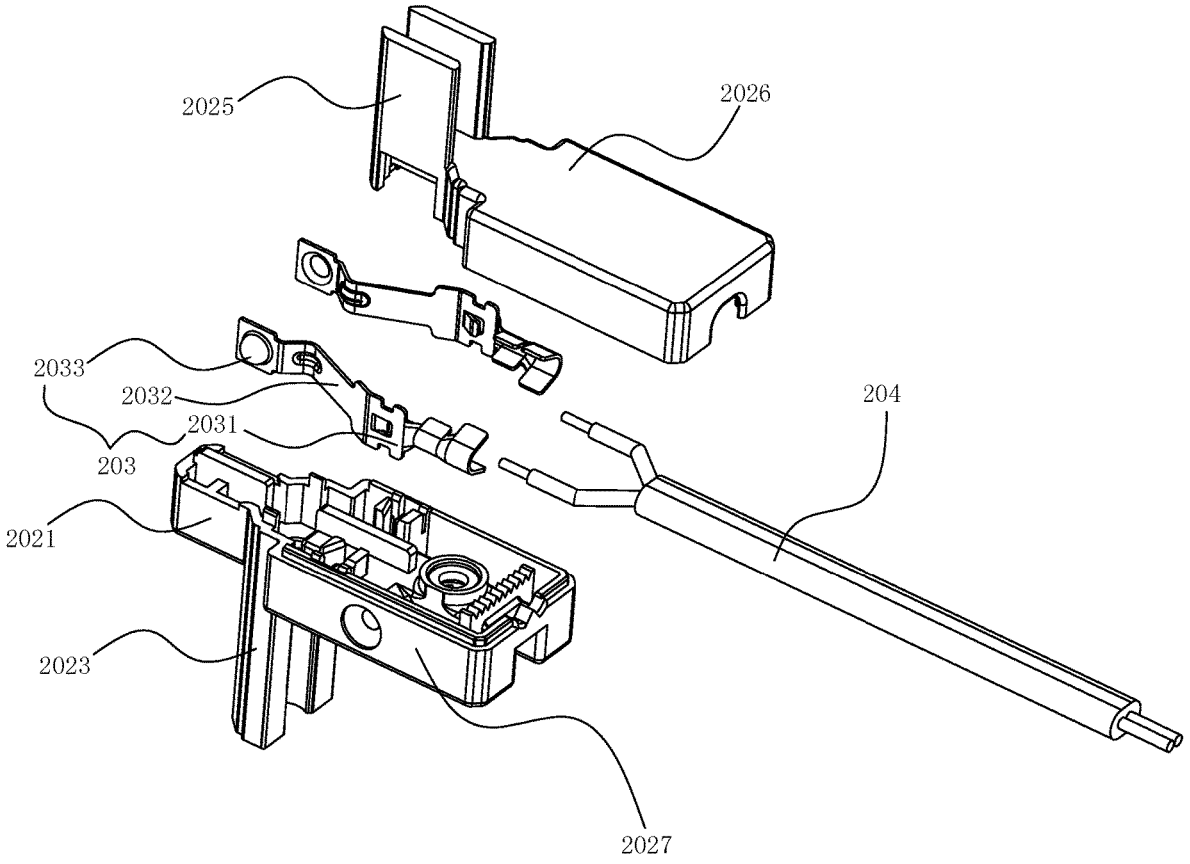
FIG. 7 is an explosive structure view of the electrical component (removal laminate fixing member) of the present embodiment.
Figure 8:
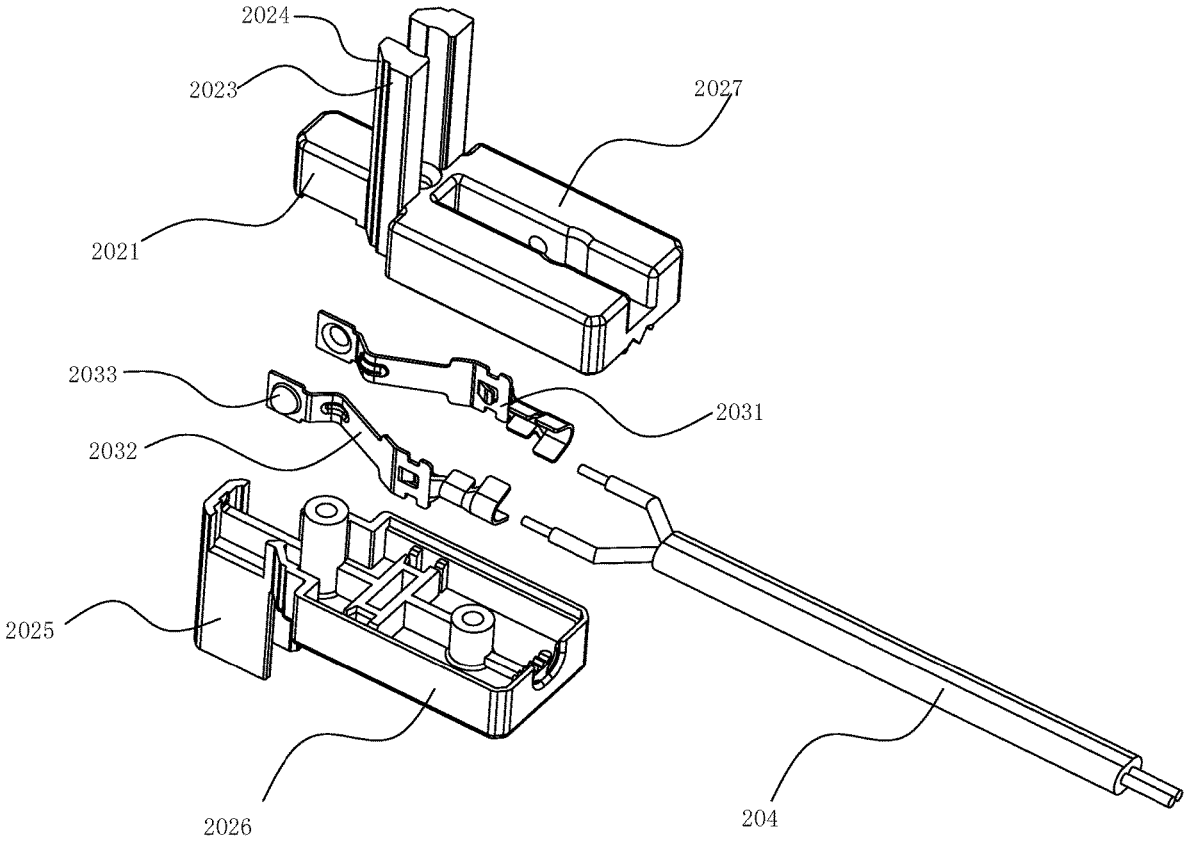
FIG. 8 is an exploding structure view of the electrical component (removing the laminate fixing member) from another angle of the present embodiment.
Figure 9:
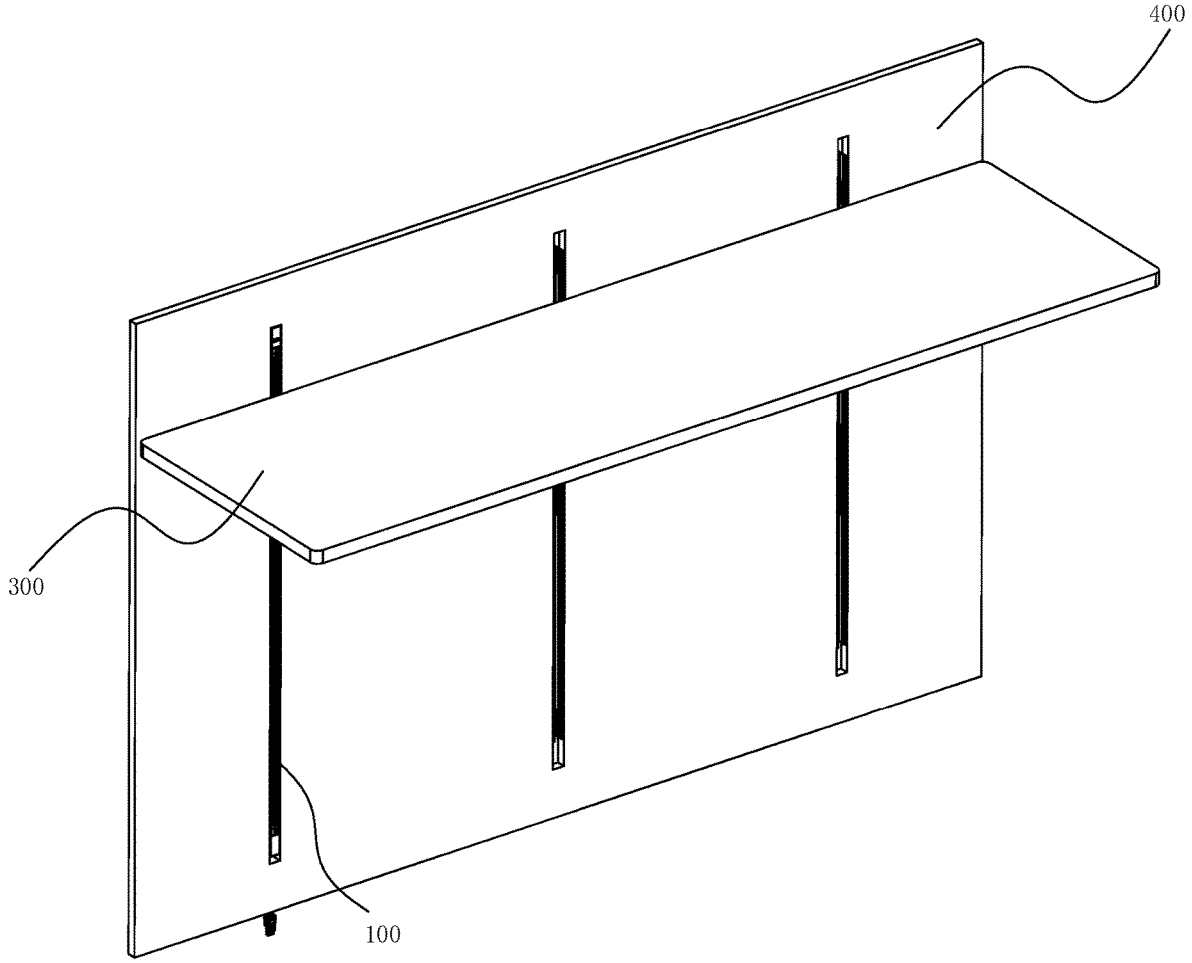
FIG. 9 is a schematic diagram of the embedded shelf power taking system in the present embodiment after installed.
Figure 10:
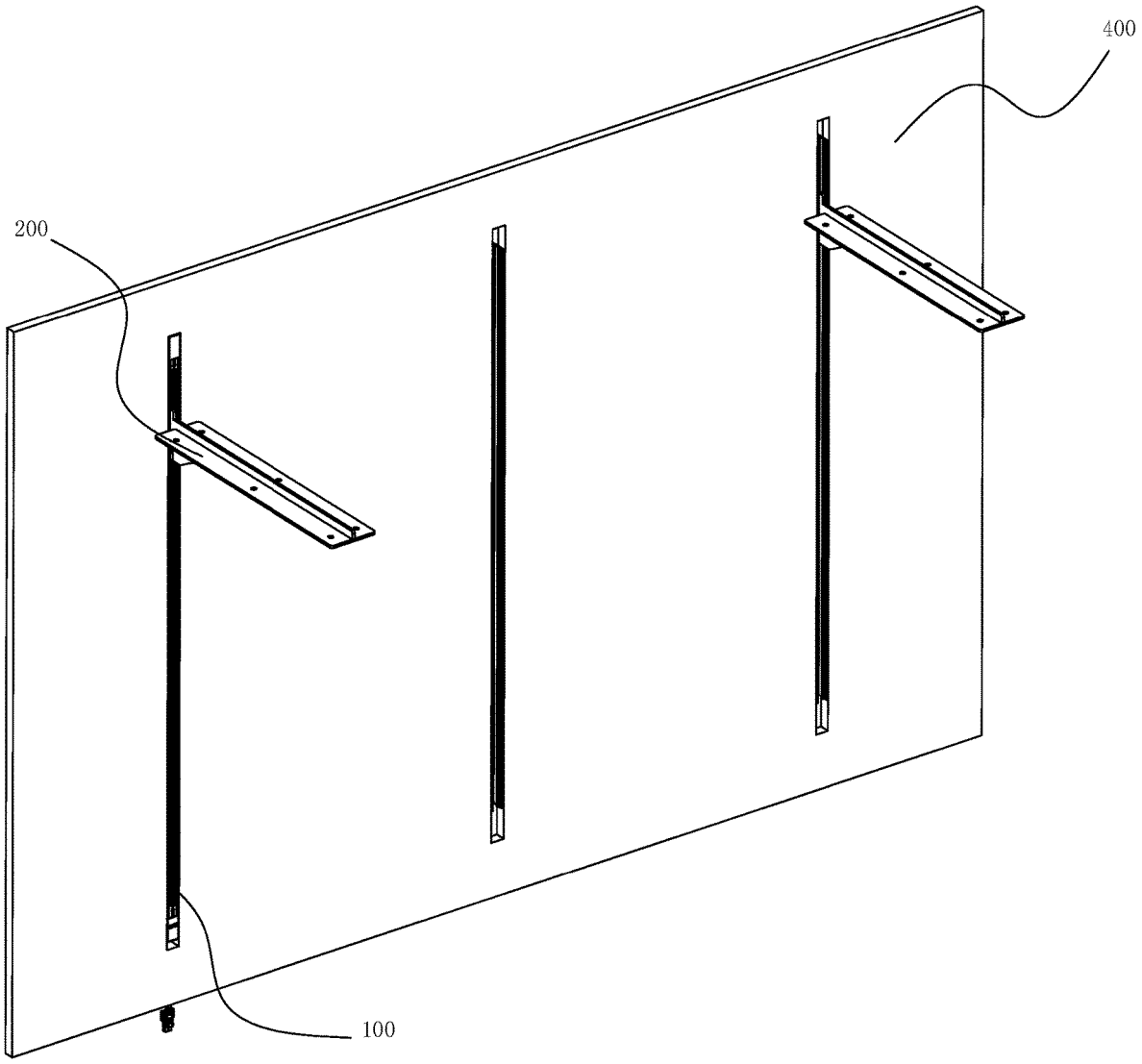
FIG. 10 is a schematic diagram of the embedded shelf power taking system for the present embodiment (Removing the laminate) after installed.
Figure 11:
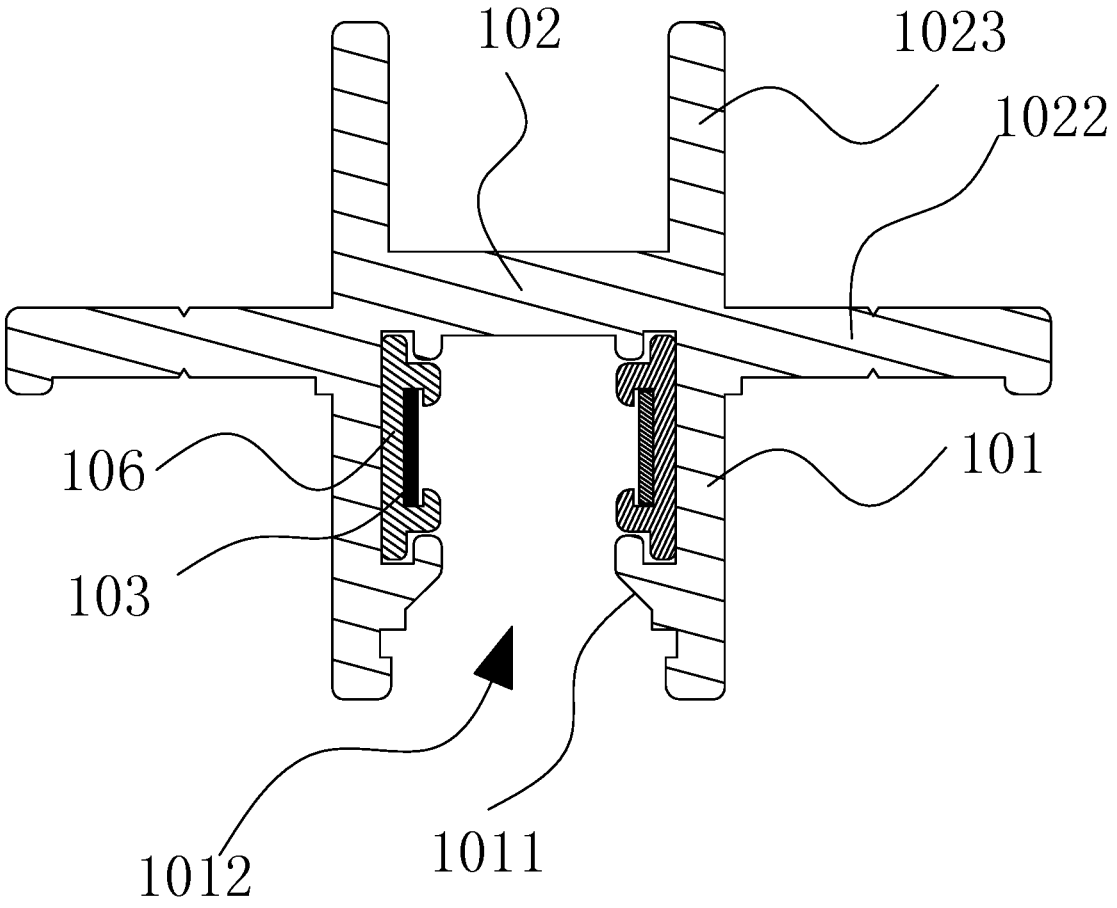
FIG. 11 is a schematic structural diagram of a cross section of the power supply rail in this present embodiment.
Figure 12:
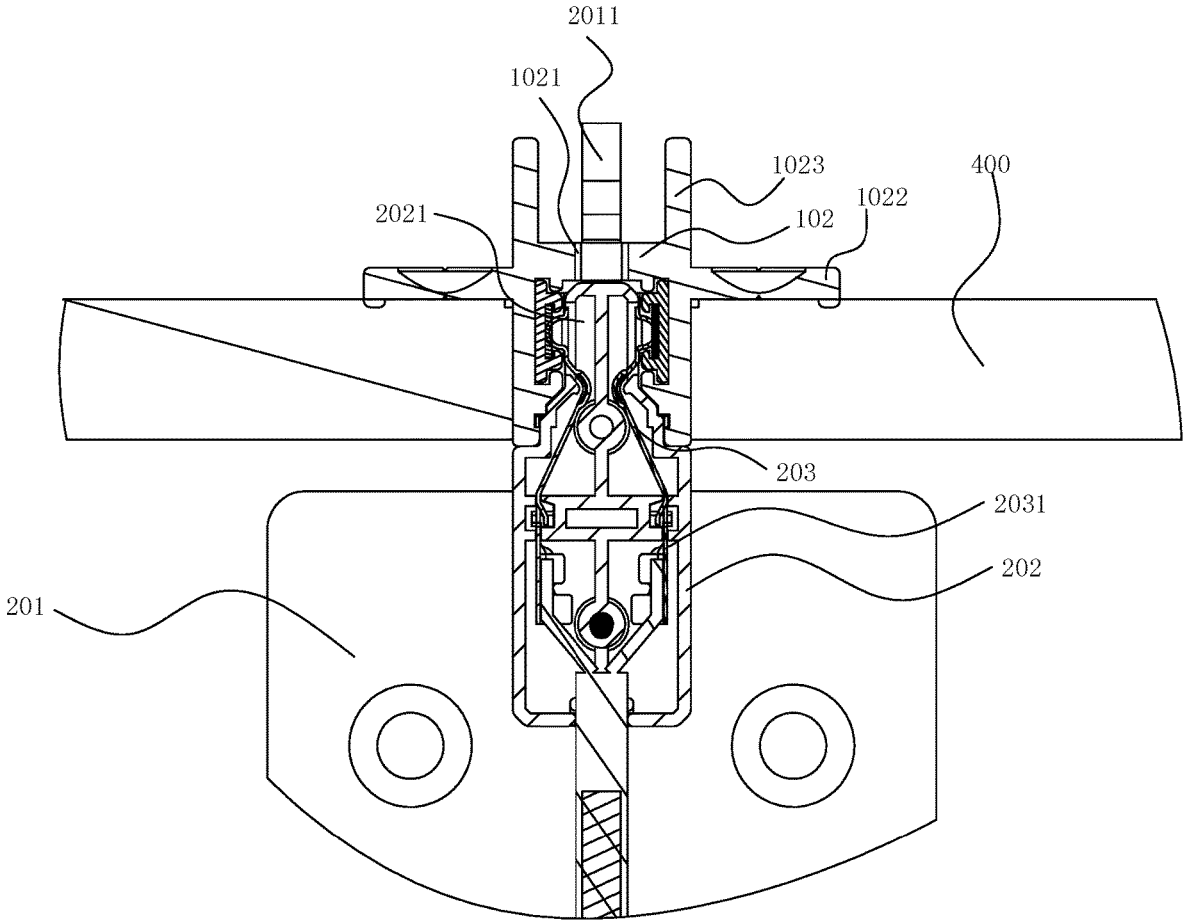
FIG. 12 is a cross-sectional structure view of the embedded shelf power taking system for the present embodiment at the electrical component.

As shown in FIG. 1-12, the embedded shelf power taking system of the present embodiment includes a power supply track 100 and an electrical component 200 disposed on the power supply track 100. The power supply track 100 of the present embodiment supplies power while providing the support for the fixing laminate.

The power supply track 100 includes two strip-shaped baffles 101, a bottom plate 102 and two strip-shaped electrical conductive members 103; the two strip-shaped baffles 101 are arranged opposite, and the two strip-shaped baffles 101 of this present embodiment are arranged in parallel or at a certain angle. The bottom plate 102 is located on the same side of the two strip-shaped baffles 101 and connected to the two strip-shaped baffles 101, and the two strip-shaped electrical conductive members 103 are respectively disposed on the inside of the two strip-shaped baffles 101. The electrical component 200 includes a laminate fixing member 201, a mounting seat 202, two elastic electrical taking members 203, and an external connector 204; the laminate fixing member 201 is fixedly connected with the power supply track 100, so as to realize the fixation of laminate 300. There are many ways of connection, and the method of screw locking is adopted in this embodiment. The mounting seat 202 is fixed to the laminate fixing member 201 and is provided with a socket 2021 which can be inserted between two strip-shaped baffles 101, and two elastic electrical taking members 203 are disposed in the mounting seat 202. Each elastic electrical taking member includes a fixing portion 2031 arranged on the mounting seat 202 and an elastic portion 2032 extending from the fixing portion 2031 to the socket 2021. Two elastic portions 2032 are respectively disposed on both sides of the socket 2021 and are connected with the strip-shaped electrical conductive member 103; The external connector 204 is electrically connected with the elastic electrical taking member 203, and the electrical connection can be welding or plugging. While the laminate fixing member 201 is fixed to the power supply track 100, the socket 2021 is inserted between the two strip-shaped baffles 101, so that the two elastic portions 2032 are in contact with the two strip-shaped electrical conductive members 103, respectively, and the electricity is transmitted from the power supply track 100 to the external connector 204. Further, both ends of the power supply track 100 provide end covers 104 and an incoming wire plug 105, which can be used with existing technology and will not be described. The external connector 204 can be a socket or a plug, with a wire or without a wire, which can be used in the prior art.

Further, the bottom plate 102 is provided with a plurality of connecting holes 1021 that are distributed in the longitudinal direction, and the laminate fixing member 201 is provided with a hook portion 2011 matching with the connecting hole 1021. The hook portion 2011 passes between two strip-shaped baffles 101 and passes through the connecting hole 1021. Due to the gravity of the laminate 300, the hook part 2011 is against the back of the bottom plate 102 to achieve fixed installation. During the above process, the socket 2021 is simultaneously inserted between the two strip-shaped baffles 101, so that the two elastic portions 2032 are in contact with the two strip-shaped electrical conductive members 103, respectively, so that the electricity is transmitted from the power supply track 100 to the external connector 204.

Further, the outer side of the strip-shaped baffle 101 is provided with an outwardly extending first fixing plate 1022. The first fixing plate 1022, the two strip-shaped baffles 101 and the bottom plate 102 can be integrally molded. The first fixing plate 1022 is abut against the back of the mounted wall panel 400 and then is fixed by fasteners.

Further, the outer side of the bottom plate 102 is provided with an outwardly extending second fixing plate 1023. The second fixing plate 1023, the first fixing plate 1022, the two strip-shaped baffles 101 and the bottom plate 102 can be formed in an integral manufacturing. The second fixing plate 1023 can be fixedly connected with other building materials behind the wall panel 400, so as to improve the overall strong degree.

Further, the inner side of the strip-shaped baffle 101 is provided with an inclined guide section 1011, and the two guide sections 1011 form a guide zone 1012, which can guide socket 2021 easier to enter.

In order to improve the installation stability of the laminate 300 and prevent left-right shaking, the mounting seat 202 further includes a strip-shaped positioning piece 2023 that is clamped into the guide zone 1012. The strip-shaped positioning piece 2023 extends along the length direction of the power supply track 100 and is provided with positioning slopes 2024 that abutting cooperates with the guide sections 1011. The strip-shaped positioning piece 2023 can limit the movement of the electrical component 200 in the plane perpendicular to the length direction of the power supply track 100, thus making the laminate 300 installed on the electrical component 200 stable.

Further, the strip-shaped baffle 101 is made of metal material. The power supply track 100 further includes a strip-shaped insulating lining plate 106 arranged inside the strip-shaped baffle 101, and the strip-shaped electrical conductive member 103 is arranged on the strip-shaped insulating lining plate 106. Metal materials have better strength and are easier to manufacture than materials like plastic. The cross section of the strip-shaped electrical conductive member 103 can be of any shape, in the present embodiment, the strip-shaped electrical conductive member 103 is a sheet, which has a larger contact surface.

Further, the socket 2021 is a hollow shell structure, and an opening 2022 is arranged on both sides for the elastic portion 2032 to extend out. The shell structure can make better fixing of the elastic portion 2032, while the opening 2022 is set so that the elastic portion 2032 can partially extend out to electrically contact with the strip-shaped electrical conductive member 103.

Specifically, the mounting seat 202 of the present embodiment includes a upper shell 2026 and a lower shell 2027, Between the upper shell 2026 and the lower shell 2026, a card slot can be set to install the fixing portion 2031. How to achieve the fixing is an existing technology, which will not be described again.

Further, the fixing portion 2031 and the elastic portion 2032 are integrally formed elastic sheets, The elastic portion 2032 is formed by the fixing portion 2031 extending to the socket 2021. The elastic portion 2032 can also be in other forms, such as spring pins, including springs and thimbles, which are prior art and will not be described herein.

The elastic part 2032 is provided with a hemispherical convex point 2033 protruding outward as a contact point. Hemispherical convex point 2033 adopts multiple stamping molding to ensure the contact area and improve the reliability, rather than destructive connection, effectively solve the problem of poor contact and contact failure caused by the long-term use of multiple disassemblies.

The elastic portion 2032 bends inward from the fixing portion 2031 and bends outward near the socket 2021. The above structure can improve the elasticity of the elastic portion 2032.

Both sides of the socket 2021 are provided with a positioning wall 2025 extending along the length direction of the power supply track 100. The positioning wall 2025 can limit the movement of the electrical component 200 in the plane perpendicular to the length direction of the power supply track 100, thus making the laminate 300 installed on the electrical component 200 stable.

The above are only preferred embodiments of the present invention, and are not used to limit the protection scope of the present invention. Any modification, equivalent replacement or improvement within the spirit of the present invention is covered by the scope of the claims of the present invention.

What is claimed is:

1. An embedded shelf power taking system, comprising a power supply track (100) and an electrical component (200) disposed on the power supply track (100), characterized in that the power supply track (100) comprises:

two strip-shaped baffles (101), which are arranged opposite;

a bottom plate (102), located on the same side of the two strip-shaped baffles (101) and connected to the two strip-shaped baffles (101);

and two strip-shaped electrical conductive members (103), which are arranged on the inside of the two strip-shaped baffles (101), respectively;

the electrical component (200) comprises:

a laminate fixing member (201), which is fixedly connected with the power supply track (100);

a mounting seat (202), which is fixed to the laminate fixing member (201) and is provided with a socket (2021) which can be inserted between two strip-shaped baffles (101);

two elastic electrical taking members (203), which are arranged in the mounting seat (202);

each elastic electrical taking member (203) comprises a fixing portion (2031) arranged on the mounting seat (202) and an elastic portion (2032) extending from the fixing portion (2031) to the socket (2021), and the two elastic portions (2032) are respectively disposed on both sides of the socket (2021) and are connected with the strip-shaped electrical conductive member (103);

and an external connector (204), which is electrically connected with the elastic electrical taking member (203).

2. The embedded shelf power taking system as claimed in claim 1, wherein the bottom plate (102) is provided with a plurality of connection holes (1021) that are distributed in the longitudinal direction, and the laminate fixing member (201) is provided with a hook portion (2011) matching with the connecting hole (1021).

3. The embedded shelf power taking system as claimed in claim 1, wherein the outer side of the strip-shaped baffle (101) is provided with an outwardly extending first fixing plate (1022).

4. The embedded shelf power taking system as claimed in claim 1, wherein a outer side of the bottom plate (102) is provided with an outwardly extending second fixing plate (1023).

5. The embedded shelf power taking system as claimed in claim 1, wherein the inner side of the strip-shaped baffle (101) is provided with an inclined guide section (1011), and the two guide sections (1011) form a guide zone (1012).

6. The embedded shelf power taking system as claimed in claim 5, wherein the mounting seat (202) further comprises a strip-shaped positioning piece (2023) that is clamped into the guide zone (1012), and the strip-shaped positioning piece (2023) extends along the longitudinal direction of the power supply track (100) and is provided with a positioning slope (2024) that abutting cooperates with the guide section (1011).

7. The embedded shelf power taking system as claimed in claim 1, wherein the strip-shaped baffle (101) is made of metal material, and the power supply track (100) further comprises a strip-shaped insulating lining plate (106) arranged inside the strip-shaped baffle (101), and the electrical conductive member (103) is arranged on the strip-shaped insulating lining plate (106).

8. The embedded shelf power taking system as claimed in claim 1, wherein the socket (2021) is a hollow shell structure, and an opening (2022) is arranged on its both sides for the elastic portion (2032) to extend out.

9. The embedded shelf power taking system as claimed in claim 1, wherein the fixing portion (2031) and the elastic portion (2032) are integrally formed elastic sheets, and the elastic portion (2032) is formed by the fixing portion (2031) extending to the socket (2021).

10. The embedded shelf power taking system as claimed in claim 1, wherein the elastic portion (2032) is provided with a hemispherical convex point (2033) protruding outward as a contact point.

11. The embedded shelf power taking system as claimed in claim 1, wherein the elastic portion (2032) is bent inward from the fixing portion (2031) and bent outward near the socket (2021).

12. The embedded shelf power taking system as claimed in claim 1, wherein both sides of the socket (2021) are provided with a positioning wall (2025) extending along the length direction of the power supply track (100).

* * * * *